United States Patent [19]

Lerique

[11] Patent Number: 4,568,221

[45] Date of Patent: Feb. 4, 1986

[54] DEVICE FOR ANCHORING UNDERWATER PIPES IN A FIXED SLEEVE

[75] Inventor: Marc Lerique, Billiere, France

[73] Assignee: Societe Nationale Elf Aquitaine (Production), Paris, France

[21] Appl. No.: 444,469

[22] Filed: Nov. 24, 1982

[30] Foreign Application Priority Data

Dec. 4, 1981 [FR] France ..... 81 22743

[51] Int. Cl.[4] ..... F16L 1/04; E21B 43/013

[52] U.S. Cl. ..... 405/169; 166/343; 166/347

[58] Field of Search ..... 405/158, 172, 169, 170, 405/195, 173; 166/339, 341–345, 347, 351, 352, 362; 285/18, 24, 27

[56] References Cited

U.S. PATENT DOCUMENTS

| | | | |
|---|---|---|---|
| 3,585,805 | 6/1971 | Vincent | 405/169 |
| 3,599,436 | 4/1971 | Lochridge | 405/169 |
| 3,604,731 | 9/1971 | Petersen | 166/347 X |
| 3,695,350 | 10/1972 | Petersen | 405/169 |
| 3,729,941 | 5/1973 | Rochelle . | |
| 3,846,992 | 11/1974 | Liataud | 405/169 |
| 4,161,367 | 7/1979 | Cuiper et al. | 166/343 X |
| 4,371,291 | 2/1983 | Morrill et al. | 166/343 X |

FOREIGN PATENT DOCUMENTS 2381957 9/1978 France .

*Primary Examiner*—Cornelius J. Husar
*Assistant Examiner*—Nancy J. Stodola
*Attorney, Agent, or Firm*—Poms, Smith, Lande & Rose

[57] ABSTRACT

A device for connection of underwater cables or pipes to a submerged structure. In a pulling head (3) is housed a connecting nose comprising a stop base (5) integral with one end of a cable, a cable section (4), a guide ring (32) and a joining pear (17) integral with the other end of the cable (4), a locking drawer (10) in the form of a plate serving as abutment for the stop base (5) and having a keyhole shaped orifice, one portion (10*a*) of which has a diameter less than the diameter of the stop base (5), is mounted by means of destructible members (7) in the pulling head (3), transversely to its axis, in a plane corresponding to that of the connecting nose where the cable section (4) is situated, so that the drawer (10), in the working position, blocks by abutment the base (5), the cable being inside said portion (10*a*), means (31, 36) being provided for breaking the destructible members (7) and for causing the drawer (10) to slide to a position, where another portion (10*b*) of the orifice of diameter greater than that of the base (5) is placed in the axis of the cable. The device is useful for the remote controlled reception and anchorage of one end of an underwater pipe or cable.

5 Claims, 4 Drawing Figures

DEVICE FOR ANCHORING UNDERWATER PIPES IN A FIXED SLEEVE

The present invention relates to the field of the remote controlled connection of one or more underwater cables or pipes, such as connecting pipes in the oil industry to a submerged structure, such as a well head, and more particularly to a device for anchoring a cable or pipe end in a fixed sleeve. Such devices are known for remote controlled position, orientating and locking, in which the end of a pipe, such as a connecting pipe head, is drawn through a pulling head fixed to the connecting head by means of a cable passing through a fixed sleeve, the pulling head being orientated, immobilized and locked inside the sleeve and the cable being freed and released. In these devices, the locking action must be followed by the action for releasing the cable, for example by controlling a cylinder and piston device, the two actions being carried out separately. Such a circumstance presents a risk due to an additional action, for example if the system for releasing the cable does not operate, the cable remains imprisoned in the connecting head after locking.

The aim of the invention is to provide a device for simultaneously effecting by means of a single control means, for example, by means of a piston and cylinder device, the locking of the connecting pipe and release of the cable. The device of the invention is characterized in that in the pulling head is housed a connecting nose comprising a stop base integral with one end of a cable or a rod, a bared cable or rod section, a guide ring and a joining pear shaped means integral with the other end of the cable or the rod, a locking drawer in the form of a plate serving as abutment for the stop base and having an orifice in the shape of a keyhole, one portion of which has a diameter less than the diameter of the stop base, is mounted by means of destructible members in the pulling head, transversely to its axis, in a plane corresponding to that of the connecting nose where the bared cable or rod section is located, so that the drawer, in the working position, blocks by abutment the stop base, the cable being inside said portion of the orifice. Means are provided for breaking the destructible members holding the drawer in place and for causing the drawer to slide in a translational movement to a position where another portion of the orifice of the drawer of a diameter greater than that of the stop base is placed in the axis of the cable and releases the cable.

According to a preferred embodiment, a piston and cylinder device is mounted inside the sleeve in a plane corresponding to the location of the locking drawer in the pulling head, the piston head in the cylinder or its extension being housed in an upper drawer formed in the sleeve, so as to be able to exert a thrust on the drawer and modify the position of the keyhole orifice of the drawer with respect to the axis of the cable.

In an advantageous embodiment, the drawer terminates at the end opposite the one receiving the thrust from the piston in a tenon situated opposite an aperture provided in the body of the sleeve, whose position is diametrically opposite to that of the cylinder.

Other locking means, of which the drawer is a carrier, is also contemplated.

The means for angular orientation and immobilization of the pulling head may comprise, in the body of the sleeve, in the same plane or in an offset plane, preferably in front of the plane of the locking drawer, at least one straightening or truing finger projecting from the inner face of the sleeve and in which is housed a pawl provided with return means, on the external face of the pulling head, helical converging ramps adapted to cooperate with the straightening finger and, at the point of convergence of the ramps, a cavity serving as housing for the pawl.

The accommodating socket serving as wedge for the joining pear of the collecting nose as well as the end of the pulling head extending from the sleeve, have a rounded shape capable of causing the pawl to retract when passing.

Other features of the invention will appear from the following description of one embodiment illustrated by the drawings in which.

Figure 4:
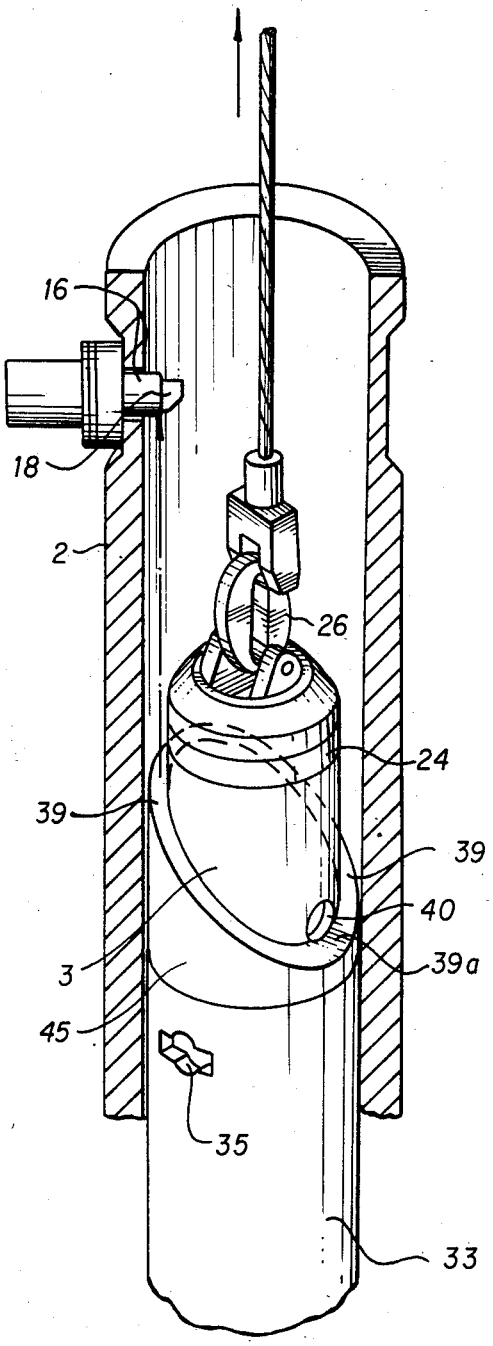

FIG. 4 is a perspective view of the leading end portion of pulling head 3 with pulling cable, joining pear, with fixed sleeve 2 shown in part section receiving the leading end portion of the pulling head and the approach of ramp 39 to finger 16 prior to positioning and immobilization of the pulling head in the fixed sleeve.

A connecting head 1 is integral with one end of a pulling head 3 comprising a hollow tube element 33 having guide pullers, a housing 34 for a stop base 5 of the cable 4 and a housing 35 for a locking drawer 10. At the opposite end of the pulling head is housed, inside the head, a connecting nose comprising a stop base 5 of the cable 4, a bared cable section 4, a guide ring 32 and a joining pear 17. The joining pear 17 is wedged inside the pulling head 3 by means of an accommodating socket 25 having a clamping ring 24 for tensioning the cable for passing through the connecting nose.

The joining pear 17 and the accommodating socket 25 extend from the pulling head 3, a chain link 26 serving for hitching a pulling cable or chain not shown.

A fixed sleeve 2 comprises an inlet bell mouth, a trumpet mouthpiece section, a cylindrical portion and a truncated cone shaped restriction for better centering. It is intended for guiding the pulling head 3 having the connecting nose. For this purpose, means for the angular orientation and immobilization of the pulling head 3 inside sleeve 2 comprise, on the one hand, fixed to the body of the sleeve, a straightening finger 16 projecting from the inner face of the sleeve, in which finger is housed a pawl 18 having a return spring 12. On the external face of the body of the pulling head 3, formed by a truncated cylinder portion 45 seated on a shoulder 46 on pulling head 3, or cut out in the cylindrical body of the pulling head 3, are provided two helical converging ramps 39 adapted to cooperate with the straightening finger 16 and, at the point of convergence of the ramps, a cavity, 40, serving for housing the pawl 18. Two straightening fingers may also be provided placed in the same horizontal plane. The accommodating socket 25, serving as wedge for the joining pear, as well as the end of the pulling head 3, has a rounded form capable of causing the pawl 18 to retract when passing thereby.

In a transverse plane of the device, offset or spaced downwardly with respect to where the above described pawl and finger means are housed for the angular orientation and immobilization of the pulling head, is placed the locking device of the invention.

In a housing or transverse chamber 35 provided inside the pulling head 3 is slidably mounted a drawer 10 for stopping the base 5 of cable 4. This drawer 10, carried in head 3 by means of spring pushers 22 passing through the pulling head 3, is held in position by means of shear pins 7, which secure the drawer to the walls of the pulling head 3. It is provided with a keyhole shaped aperture whose low portion 10*a* has a diameter less than that of base 5, whereas the upper portion 10*b* has a diameter greater than that of the base. Outside the sleeve 2, in a plane corresponding to the location of the locking drawer 10, in the pulling head 3, is mounted a piston and cylinder device, whose piston head 36 or its extension is aligned with an aperture formed in the sleeve at this position.

In the same transverse plane, a pusher 31 is held temporarily in position by means of pins 7*a* in a pusher guide 19 fixed to the sleeve body 2. A resilient steel pin 8 cooperates with housing formed in the circumference of pusher 31 to prevent the pusher from returning after locking.

The locking drawer 10 is integral, at its end opposite the one receiving the thrust of pusher 31, with a tenon 37 placed opposite another aperture formed in the body of sleeve 2 and in the pulling head 3.

Figure 1:
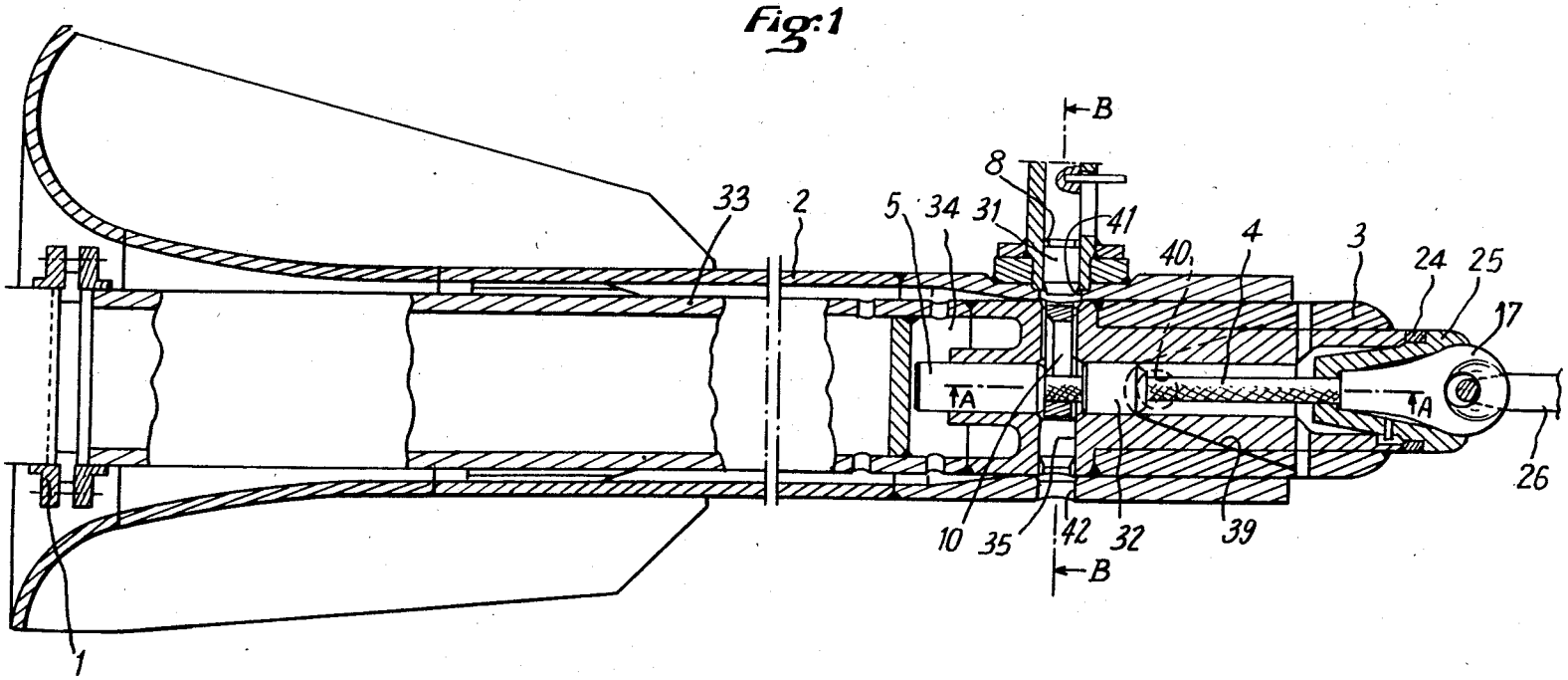
FIG. 1 is an axial sectional view of the anchorage device mounted in a fixed sleeve, on a subsea installation in accordance with the invention, of an underwater pipe.
Figure 2:
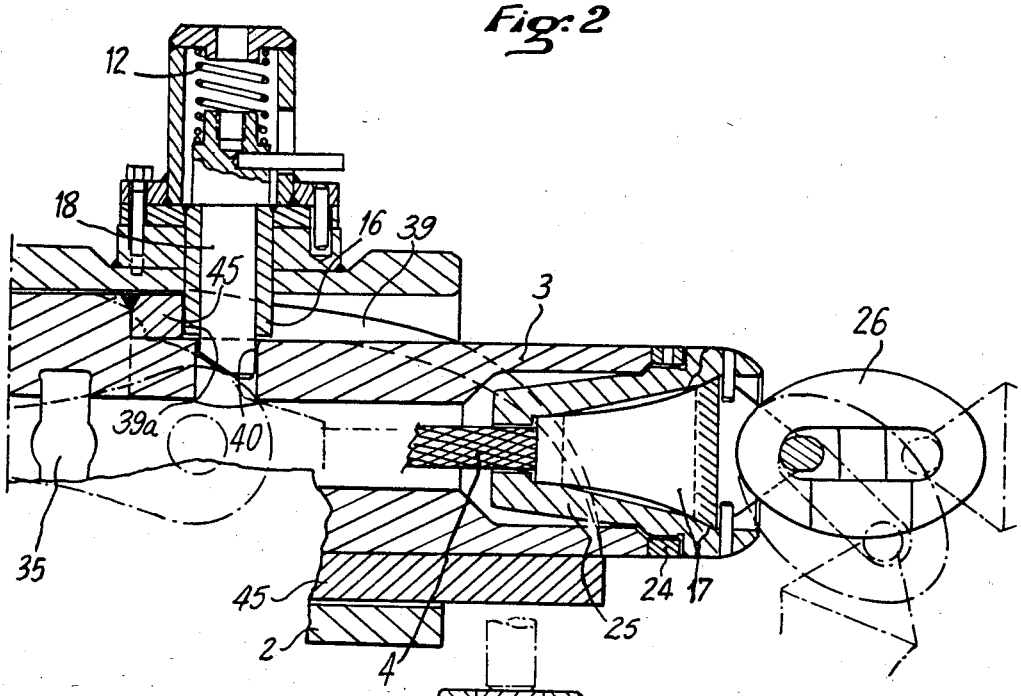
FIG. 2 is a sectional view along A—A of FIG. 1.
Figure 3:
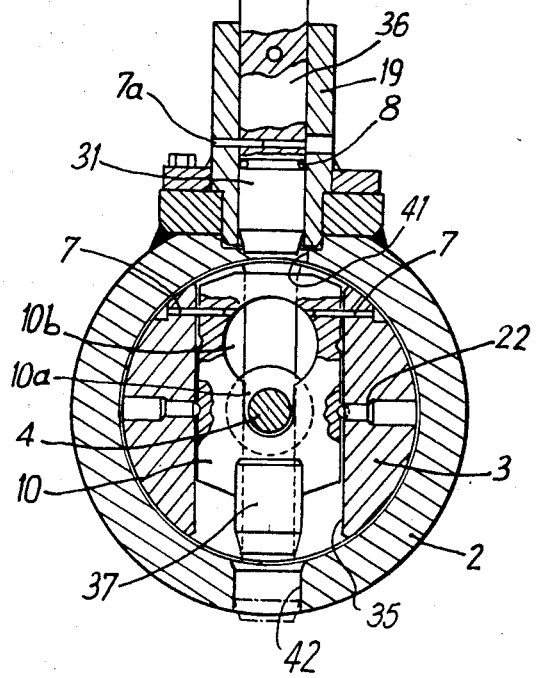
FIG. 3 is a sectional view along B—B of FIG. 1.

The operating axes of the straightening finger 16 and of the locking drawer 10 are offset by an angle of 90° and placed in two different transverse planes, the plane of the angular orientation and immobilization means being preferably offset in front of or above, as viewed in FIG. 1, the plane of the locking drawer.

At the beginning of the operation for connecting the connecting head to a fixed sleeve on a subsea installation, the device of this invention including hollow tube element 33, stop base 5, drawer 10, cable 4, guide ring 32, joining pear 17, and pulling head 3, in assembly as shown in FIG. 1, are mounted on the connecting head by suitable flange and nut and bolt assembly. In such initial assembly it should be noted that a bared section of cable 4 extends through locking drawer 10 at its narrowest width and that the upper end face of stop base 5 is in abutment with the locking drawer. Cable tension in cable 4 is provided by clamping ring 24. The eyelet in joining pear 17 provides a connection to a pulling cable or chain 26.

The assembled device, now carried on connecting head 1 and joined to cable 26 by pear 17, may be towed by a tug towards a fixed or floating structure provided with a pulling winch and a fixed sleeve 2. A pilot cable (not shown) wound on the winch may be passed through fixed sleeve 2 and connected to cable 26 for pulling the connecting head 1, through the action of the winch, towards the open bell-shaped mouth of the fixed sleeve 2. The pulling forces are transmitted to the connecting head 1 through the pulling head 3, and the abutment of the end of the stop base 5 with the lock drawer 10 when the lock drawer is in the position shown in FIG. 1.

As the pulling head assembly progresses along the inside of sleeve 2, FIG. 4, guiding of pulling head 3 is facilitated by guide collars and as pulling head 3 approaches the remote end of sleeve 2, the straightening finger 16 carried by sleeve 2 engages one of the helical ramps 39 adjacent the upper end of pulling head 3 and causes pulling head 3 to turn on its longitudinal axis to angularly orient pulling head 3 with respect to sleeve 2. When the straightening finger 16 reaches the bottom of ramp 39 it abuts the end or bottom face 39*a* (FIG. 4) of the ramp. In such position pawl 18 is aligned with opening 40 in the pulling head 3 and relative longitudinal movement of pulling head 3 and sleeve 2 is stopped or immobilized. The spring biased pawl 18, having been urged into a retracted position by contact with pulling nose 3 as finger 16 moves along ramp 39, immediately enters opening 40 in the pulling head 3 and immobilizes head 3 in sleeve 2 in a selected angular and longitudinal position.

Since pulling head 3 is now angularly and longitudinally positioned, it is also properly positioned for actuation of the locking drawer 10 carried in housing chamber 35 which is longitudinally spaced from opening 40 and angularly offset therefrom about 90°. In such position the pusher 31 and tenon 37 on the locking drawer are in alignment with each other and in alignment with ports 41, 42 in sleeve 2 to permit actuation of locking drawer 10. Pusher 31 is actuated by means of a cylinder with a piston 36 whose thrust shears break pins 7 and 7*a* and causes locking drawer 10 to be moved in chamber 35 transversely of pulling head 3 and sleeve 2. During this transverse movement, pusher 31 enters port 41 and tenon 37 enters locking port 42 in sleeve 2. The wide portion 10*b* of the orifice or keyhole opening in the locking drawer 10 has been displaced into alignment with the cylindrical stop base 5. Since the outer diameter of the stop base 5 is less than the inner diameter of the opening 10*b*, the stop base 5 freely passes through the locking drawer. Cable 4 with stop base 5, guide ring 32, socket 25, and pear 17 is thereby freed from pulling head 3 and the fixed sleeve 2. Since the lateral displacement of locking drawer 10 caused insertion of tenon 37 into port 42 in sleeve 2, and pusher 31 into port 41, the pulling head remains locked in sleeve 2. Pusher 31 is retained in its pushed-in position by resilient steel pin 8.

Thus, from the moment of locking of pulling head 3 in sleeve 2 by locking drawer 10, the cable 4 and its pulling cable 26 is freed and automatically released from head 3 and readily pulled clear of fixed sleeve 2.

With the device of the invention, the action of freeing the cable may be associated with and made dependent on the action of locking the connecting pipe. The number of mechanisms is thus reduced, while this device prevents any false manoeuvres, for the beginning of locking provided by pawl 18 occurs before freeing of the cable. The action of tenon 37 completes the role of the pawl, which is that of immobilization.

The operation of the device is thus extremely simplified, for, since the orientation and immobilization of the pulling head takes place automatically through the action of the pull alone, it is sufficient to actuate the cylinder and piston device at the desired moment to provide a solidly locked connection. Since the effect of the remote control of the piston and cylinder device inevitably takes place with a delay, the first action of the pawl already immobilizes the pulling head. Thus, the locking action takes place necessarily after immobilization. The action of the system releasing the tension of the cable is facilitated for, otherwise, a certain tension would have to be maintained in the cable until the connecting pipe was locked.

The device of the invention finds an application in the reception and anchorage of an end of one or more electric underwater pipes or cables and may be wholly controlled from the surface.

In particular, in the oil industry, it allows a peripheral well to be connected to a central structure, or a first end of a pipe to be anchored to the foot of an oil platform.

I claim:

1. A device for anchoring the end of one or more underwater cables or pipes in a fixed sleeve having a locking port (42) in which a pulling head (3) is fixed to a connecting head (1) on the end of a pipe, the pulling head having a transverse housing chamber 35 and being connected to a pulling cable passing through the fixed sleeve (2) and being angularly oriented, immobilized and locked inside the fixed sleeve and upon locking the pulling cable being freed and released, comprising, in combination:

said pulling head (3) including a pulling cable connecting nose comprising a stop base (5), a cable (4) connected to one end of the stop base (5), a guide ring (32) carried on cable (4) and spaced from said stop base to provide a bared cable section, and ajoining pear (17) integral with the other end of cable (4) and adapted for connection to a pulling cable (26);

a locking drawer (10) with a locking tenon (37) retained in a non-locking and pulling position in said housing chamber during pulling and adapted to be transversely slidably actuated to locking and non-pulling position in said connecting nose, said drawer having a keyhole shaped aperture in which one portion (10*a*) has a diameter less than the diameter of stop base (5) to provide abutment faces against which said stop base abuts during pulling, said bared cable section being received in said one aperture portion (10*a*);

said locking drawer (10) having an opening (10*b*) larger than the diameter of the stop base (5) to permit its passage there through after being transversely positioned in locking position of the drawer (10) with sleeve (2);

means for orienting and immobilizing said pulling head (3) with respect to said fixed sleeve (2) to longitudinally and transversely align tenon (37) and locking port (42); and means on said sleeve (2) for activating said locking drawer (10) in such oriented non-locking position to lock the pulling head (3) in the fixed sleeve (2) upon transversely slidably displacing said locking drawer (10) into locking position where said cable (4) and stop base (5) are aligned with opening 10*b* and released from said pulling head upon such locking operation.

2. A device as defined in claim 1 wherein said means on said sleeve for actuating said locking drawer includes a piston and cylinder means mounted externally of sleeve (2) in a plane corresponding to the position of the locking drawer (10) in pulling head (3), said sleeve (2) being provided with a port (41) to receive the end of said piston, said piston when actuated exerting a thrust on drawer (10) to modify the position of the keyhole aperture with respect to the axis of cable (4).

3. The device as claimed in claim 1 wherein said pulling head includes a socket 25, said pear (17) is wedged in said socket, and a clamping ring (24) on said socket for tensioning cable (4) in said connecting nose.

4. The device claimed in claim 1 wherein said means for orienting said pulling head with respect to said fixed sleeve include a straightening finger (16) projecting from the internal face of sleeve (2), a biased pawl (18) having a spring member (12) housed in said finger (16), converging helical ramps on the external face of pulling head (3) cooperable with said finger (16) for angularly and longitudinally orienting said pulling head, and cavity means in said head at the point of convergence of said ramps for receiving the end of said pawl (18) for longitudinally positioning and immobilizing said pulling head in said fixed sleeve.

5. The device as claimed in claim 1 wherein said socket (25) and the end of said pulling head (3) adjacent thereto which extends from the end of sleeve (2) are provided with convex rounded surfaces for camming engagement with the end of pawl (18) to cause retraction of pawl (18) into finger (16) when the pulling head is pulled through said fixed sleeve (2).

* * * * *